US005693410A

United States Patent [19]

Malhotra et al.

[11] Patent Number: 5,693,410

[45] Date of Patent: Dec. 2, 1997

[54] INK JET TRANSPARENCIES

[75] Inventors: Shadi L. Malhotra; Kirit N. Naik, both of Mississauga; David N. MacKinnon, Etobicoke; Arthur Y. Jones, Mississauga, all of Canada

[73] Assignee: Xerox Corporation, Stamford, Conn.

[21] Appl. No.: 706,865

[22] Filed: Sep. 3, 1996

[51] Int. Cl.[6] ..... B41M 5/00

[52] U.S. Cl. ..... 428/216; 428/195; 428/704; 428/913

[58] Field of Search ..... 428/195, 212, 428/213, 215, 216, 323, 325–331, 412, 473.5, 480, 500, 522, 532, 704, 913

[56] References Cited

U.S. PATENT DOCUMENTS 4,756,961 7/1988 Mouri et al. ..... 428/323
4,997,697 3/1991 Malhotra ..... 428/195
5,202,205 4/1993 Malhotra ..... 430/17
5,212,008 5/1993 Malhotra et al. ..... 428/216

*Primary Examiner*—Pamela R. Schwartz
*Attorney, Agent, or Firm*—Eugene O. Palazzo

[57] ABSTRACT

A transparency comprised of a supporting substrate, and thereover two coatings, a first coating layer which comprises a binder having a melting point of 100° to 275° C. and a heat dissipating and a fire retardant component, a second dye immobilizing light resistant, water resistant ink receiving coating layer situated so that the first coating layer is between the second dye immobilizing light resistant, water resistant ink receiving coating layer, and the substrate, said second dye immobilizing light resistant, water resistant coating layer comprising a blend of a hydrophilic polymer, an ink spreading agent, cationic component monomeric or polymeric capable of complexing with the ink dyes used to develop the transparency, a lightfastness inducing agent, and/or mixtures thereof, a filler and a biocide, and preferably wherein the two coatings are present on each surface of the supporting substrate.

21 Claims, No Drawings

INK JET TRANSPARENCIES

REFERENCE TO PENDING APPLICATIONS

U.S. Pat. No. 5,663,004, the disclosure of which is totally incorporated herein by reference, discloses a recording sheet which comprises a substrate, an image receiving coating, and a biocide.

U.S. Pat. No. 5,624,743 the disclosure of which is totally incorporated herein by reference, discloses a transparency comprised of a supporting substrate, thereover a first coating layer comprised of a binder having a glass transition temperature of less than about 55° C., a cellulosic viscosity modifier, a lightfastness inducing agent and a biocide; and a second ink-receiving coating layer comprised of a hydrophilic binder, an oxyalkylene containing compound, a dye mordant, an optional filler, and an optional biocide; and wherein the first coating is in contact with the substrate and is situated between the substrate and the second ink coating, and which transparency possesses a haze value of from about 1 to about 10 and a lightfastness value of from about 80 to about 95.

U.S. Pat. No. 5,672,424, the disclosure of which is totally incorporated herein by reference, discloses a transparency comprised of a supporting substrate, thereover a first coating layer comprised of an anionic layer that adheres well to the substrate; and a second cationic layer situated on the top of the first anionic layer that binds with the anionic layer and comprised of cationic quaternary monomers as well as polymers and a lightfastness inducing agent; and a third ink receiving layer situated on the top of the second cationic layer and comprised of block copolymers and graft polymers, a biocide and a filler; which transparency possesses a haze value of from about 0.5 to about 10 and a lightfastness value of from about 95 to about 98.

Copending application U.S. Ser. No. 657,134, the disclosure of which is totally incorporated herein by reference, discloses a transparency comprised of a supporting substrate, thereover a first coating layer comprised of an ink absorbing layer and a biocide; and a second ink spreading coating layer comprised of a hydrophilic vinyl binder, a dye mordant, a filler, an optional lightfastness inducing agent and an ink spot size increasing agent selected from the group consisting of hydroxy acids, amino acids and polycarboxyl acids; and wherein the first coating is in contact with the substrate and is situated between the substrate and the second ink coating, and which transparency possesses a haze value of from about 0.5 to about 10 and a lightfastness value of from about 95 to about 98.

BACKGROUND OF THE INVENTION

The present invention is directed to recording sheets, such as papers and transparencies, and more specifically, to fire resistant papers and fire resistant low haze, lightfast and waterfast ink jet transparencies having improved ink absorption, and ink spreading when used in combination with slow drying inks of one color and fast drying inks of another color. In embodiments of the present invention, the transparencies are comprised of a supporting substrate, such as paper, or MYLAR® with respect to the transparency, and thereover two coatings, a first coating layer comprised of a binder having a melting point, for example, in the range of about 100° C. to about 275° C., and a heat dissipating and fire retardant component, a second dye immobilizing light resistant, water resistant ink receiving coating layer situated so that the first coating layer is between the second dye immobilizing, light resistant, water resistant ink receiving coating layer and the substrate, the second dye immobilizing light resistant, water resistant coating layer comprising a blend of a hydrophilic polymer, an ink spreading agent, cationic component monomeric or polymeric capable of complexing with dyes present in ink compositions, a lightfastness inducing agent which can contain a mixture of antioxidant, UV absorber component, and the like, a filler and a biocide, and preferably wherein the two coatings are present on each surface of the supporting substrate.

With the present invention, there is enabled providing a number of advantages, including the important advantage of fire retarding characteristics in the transparencies and papers when used in ink jet printers that employ heat or microwave energy for drying inks, low haze, that is, for example, wherein the transparencies permit greater than 95 percent of the light to be transmitted therethrough in embodiments, and which transparencies possess excellent lightfastness and waterfastness characteristics. The transparencies of the present invention can be selected for ink jet methods and apparatus, which employ slow drying inks of one color and fast drying inks of another color in order to reduce intercolor bleed. Different solvent vehicles can be used to produce slow drying inks of one color and fast drying inks of another color which necessitates developing transparencies with special surfaces to accommodate these variable ink compositions.

U.S. Pat. No. 4,997,697, the disclosure of which is totally incorporated herein by reference, discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205, the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds, both with polymers containing oxyalkylene segments.

U.S. Pat. No. 5,212,008, the disclosure of which is totally incorporated herein by reference, discloses a recording sheet which comprises a substrate; a first coating in contact with the substrate which comprises a crosslinking agent such as hexamethoxymethyl melamine, methylated melamine-formaldehyde, methylated urea-formaldehyde, cationic urea-formaldehyde, cationic polyamine-epichlorohydrin, glyoxalurea resin, poly(aziridine), poly(acrylamide), poly (N,N-dimethyl acrylamide), acrylamide-acrylic acid copolymer, poly(2-acrylamido-2-methyl propane sulfonic acid), poly(N,N-dimethyl-3,5-dimethylene piperidinium chloride), poly(methylene-guanidine) hydrochloride, poly (ethylene imine) poly(ethylene imine) epichlorohydrin, poly (ethylene imine) ethoxylated, glutaraldehyde, or mixtures thereof; a catalyst; and a polymeric material capable of being crosslinked by the crosslinking agent and which polymeric material can be selected from the group consisting of polysaccharides having at least one hydroxy group, polysaccharides having at least one carboxy group, polysaccharides having at least one sulfate group, polysaccharides having at least one amine or amino group, polysaccharide gums, poly(alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, imidazoline quaternary compounds, alkyl benzyl dimethyl quaternary compounds, poly(epiamines), and mixtures thereof.

The disclosures of each of the patents and applications recited herein are totally incorporated herein by reference in their entirety.

While the above transparencies are suitable for their intended purposes, a need remains for improved fire resistant transparencies particularly suitable for use in ink jet and electrophotographic applications that employ heat and microwave energy to fix inks and toners. In addition, a need remains for transparencies that can be used in printers that employ slow drying black inks and fast drying colored inks. In addition, a need remains for transparencies with excellent low haze characteristics, such as haze between from about 0.5 to about 10 and preferably between 0.5 to 4, and excellent lightfastness in the range of from about 80 to about 95 percent, a feature not easily obtained considering that the total thickness of the two layered coatings can range from 2 to 50 microns and average about 25 microns. There is also a need for improved waterfastness of images in the ink jet transparencies, and a need for transparencies wherein colors can be satisfactorily projected. A need also remains for transparencies which are particularly suitable for use in printing processes wherein the recorded transparencies are imaged with liquid inks and dried by exposure to microwave radiation. Further, there is a need for transparencies coated with a discontinuous porous film. There is also a need for transparencies which, subsequent to being imaged with an aqueous ink, exhibit reduced curling. These and other needs are achievable with the transparencies of the present invention in embodiments thereof.

SUMMARY OF THE INVENTION

It is an object of the present invention to provide transparencies and papers with many of the advantages illustrated herein.

It is another object of the present invention to provide fire resistant transparencies particularly suitable for use in electrophotographic and ink jet applications that employ heat and microwave energy to fix inks and toners.

It is another object of the present invention to provide transparencies particularly suitable for ink jet printers employing slow drying black inks and fast drying colored inks.

It is another object of the present invention to provide transparencies with excellent waterfast and lightfast images.

It is yet another object of the present invention to provide transparencies with low haze characteristics, such as from about 1 to about 10, and wherein the color gamut is acceptable and does not substantially change.

Moreover, another object of the present invention is to provide transparencies with the combination of excellent lightfastness properties, such as from about 90 to about 98, and low haze characteristics, such as from about 0.5 to about 10 and preferably from about 1 to about 5, wherein the color gamut is acceptable and does not substantially change.

These and other objects of the present invention can be accomplished in embodiments thereof by providing transparencies with coatings thereover. More specifically, the transparencies of the present invention are comprised of a supporting substrate, and thereover two coatings, a first coating layer which comprises a binder and a heat dissipating and fire retardant component, a second dye immobilizing light resistant, water resistant ink receiving coating layer situated so that the first coating layer is between the second dye immobilizing light resistant water resistant ink receiving coating layer and the substrate, the second dye immobilizing light resistant water resistant coating layer comprising a blend of a hydrophilic polymer, an ink spreading agent, cationic component monomeric or polymeric capable of complexing with dyes present in ink jet ink compositions, a lightfastness inducing agent, a filler and a biocide, and preferably wherein the two coatings are present on each surface of the supporting substrate.

Embodiments of the present invention include a transparency comprised of a supporting substrate, and thereover two coatings, a first heat dissipating and fire resistant coating layer in contact with the substrate and wherein the first coating is comprised of a binder with a melting point in the range of from about 100° C. to about 275° C. and a heat dissipating fire retardant component, and a second ink receiving coating layer thereover comprising a blend of a hydrophilic binder polymer, an acid ink spreading agent, a cationic component, a lightfastness inducing agent, a filler, and a biocide; a transparency comprised of a supporting substrate, thereover and thereunder a first coating layer which dissipates heat and is substantially fire resistant, and which first coating is comprised of a binder with a melting point in the range of from about 100° C. to about 275° C. and a heat dissipating fire retardant component, and wherein said binder is present in amounts of from about 5 parts by weight to about 95 parts by weight and said fire retardant component is present in amounts of from about 95 parts by weight to about 5 parts by weight; and a second ink receiving coating layer situated thereover and thereunder the first heat dissipating and fire resistant layer, and which second coating is comprised of a blend of a binder polymer, an acid ink spreading component, a cationic component, a lightfastness component, a filler and a biocide; and a transparency comprised of a supporting substrate, and thereover and thereunder two coatings, a first heat dissipating and fire resistant coating layer in contact with the substrate, and wherein the first coating is comprised of a binder with a melting point in the range of from about 100° C. to about 275° C. and a heat dissipating fire retardant component, and a second ink receiving coating layer thereover and thereunder comprising a blend of a binder polymer, a monomeric, or polymeric cationic component capable of complexing with an ink composition dye, a lightfastness component mixture, an acid ink spreading component, a filler, and a biocide. The lightfastness agent in embodiments is comprised of a mixture of a UV component, an antioxidant, and an antiozoant, and which components are present in various effective amounts such as from about 1 to about 5 parts.

Examples of substrate materials include polyesters, including MYLAR™, a polyethylene terephthalate available from E.I. DuPont de Nemours and Company, MELINEX™, polyethylene terephthalate available from Imperial Chemicals, Inc., CELANAR™, polyethylene terephthalate available from Celanese Corporation, polyethylene naphthalates, such as Kaladex PEN films available from Imperial Chemical Industries, polycarbonates, such as LEXAN™ available from General Electric Company, polysulfones, such as those available from Union Carbide Corporation, polyether sulfones, such UDEL™ available from Union Carbide Corporation, cellulose triacetate, polyvinylchloride cellophane, polyvinyl fluoride, polyimides, and the like, with polyester, such as MYLAR™, being preferred primarily because of its availability and relatively low cost. The substrate can also be opaque, including opaque plastics, such as TESLIN™ available from PPG Industries, and filled polymers available from ICI, with fillers such as oxides and sulfates.

The substrate, which preferably includes two coatings thereon, and two coatings thereunder, that is a total of four coatings, in contact with the substrate, can be of any effective thickness. Typical thicknesses for the substrate are from about 50 to about 500 microns, and preferably from about 100 to about 125 microns, although the thickness may be outside these ranges.

The first layer heat dissipating fire retardant coating composition comprises a blend of a binder with a melting point in the range of from about 100° C. to about 275° C. and preferably from about 150° C. to 260° C., such as for example polycarbonate, vinyl chloride-vinylidene chloride copolymers, such as #058 available from Scientific Polymer Products, and a heat and fire retardant compound capable of dissipating energy, such as bromo chloro paraffin available as DD-8207 from Dover Corporation, and which blend is present on the front side of the substrate of the multilayered transparency of the present invention in any effective thickness. Typically, the total thickness of this first coating layer is from about 0.1 to about 25 microns and preferably from about 0.5 to 10 microns, although the thickness can be outside of these ranges. In the first coating composition, the binder or mixtures thereof can be present within the coating in any effective amount; typically the binder or mixtures thereof are present in amounts of from about 5 parts by weight to about 95 parts by weight and the fire retardant materials are present from about 95 parts by weight to about 5 parts by weight. Preferably, binder or mixtures thereof are present in amounts of from about 50 parts by weight to about 95 parts by weight and the heat dissipating fire retardant compounds are present from about 95 parts by weight to about 50 parts by weight.

The second layer ink receiving coating composition situated on the top of the first heat dissipating and fire retardant composition layer comprises a blend of a binder polymer, an ink spreading agent, a monomeric or polymeric cationic component capable of complexing with the dye contained in ink jet ink compositions, a lightfastness inducing agent, a filler and a biocide. Typically, the total thickness of this second coating layer is from about 0.1 to about 25 microns and preferably from about 0.5 to 10 microns, although the thickness can be outside of these ranges. In the second coating composition the binder components can be present within the coating in any effective amount; typically the binder is present in amounts of from about 5 parts by weight to about 75 parts by weight and preferably from about 10 parts by weight to about 40 parts by weight, although the amounts can be outside of this range. The ink spreading agent, such as poly(alkylene oxide), homologs and copolymers thereof, are present in amounts of from about 60 parts by weight to about 5 parts by weight and preferably from about 40 parts by weight to about 4 parts by weight, although the amounts can be outside of this range. The cationic dye complexing components or mixture thereof are present in the second coating composition in amounts of from about 35 parts by weight to about 2 parts by weight and preferably from about 30 parts by weight to about 3 parts by weight, although the amounts can be outside of this range. The lightfastness inducing compounds or mixture thereof are present in the second coating composition in amounts of from about 15 parts by weight to about 1 part by weight and preferably from about 15 parts by weight to about 2 parts by weight, although the amounts can be outside of this range. The filler of the second layer coating composition is present in amounts of from about 1 part by weight to about 70 parts by weight and preferably from about 0.1 part by weight to about 50 parts by weight, although the amounts can be outside of this range. The biocides of the second layer coating composition are present in amounts of from about 5 parts by weight to about 0.1 part by weight and preferably from about 4.9 parts by weight to about 1 part by weight, although the amounts can be outside of this range.

The aforementioned amounts can be determined, for example, as follows:

Various blends of the binder, the ink spreading agent, cationic dye mordant component, lightfastness inducing agent, filler, and the biocide are generated in water and coated on to various substrates, such as paper sheets, or polyester sheets, to yield transparencies with a single layer thereover and thereunder. After drying the polyester sheets at 100° C., they were tested for coating adhesion to MYLAR®, printed with a Xerox Corporation ink jet test fixture to, for example, check print quality, drying times of the images, lightfastness and intercolor bleed. The data was analyzed statistically for optimum range of compositions. A preferred composition range for the second layer coating of the transparency is the binder present in amounts of from about 10 parts by weight to about 40 parts by weight, the ink spreading agent present in an amount of from about 40 parts by weight to about 4 parts by weight, the cationic dye complexing components present in an amount of from about 30 parts by weight to about 3 parts by weight, the lightfastness inducing agent present in amounts of from about 15 parts by weight to about 2 parts by weight, the fillers present in amounts of from about 0.1 part by weight to about 50 parts by weight, and the biocide compound present in amounts of from about 4.9 parts by weight to about 1 part by weight; total 100 parts (10+40+30+15+0.1+4.9) to (40+4+3+2+50+1).

Embodiments of the present invention include a transparency comprised of a supporting substrate, and thereover two coatings, a first coating layer which comprises a blend of a binder having a melting point in the range of 100° to 275° C. and preferably from about 150° to 260° C., for example, polycarbonates, such as #035 available from Scientific Polymer Products; vinyl chloride-vinylidene chloride copolymers, such as #058 available from Scientific Polymer Products, substituted cellulose esters such as cellulose acetate hydrogen phthalate, such as #085 available from Scientific Polymer Products, hydroxypropylmethyl cellulose phthalate, such as HPMCP available from Shin-Etsu Chemical, hydroxypropyl methyl cellulose succinate, and a fire retardant material capable of dissipating energy, such as ethylene bis-tetrabromo phthalimide available as Saytex BT-93 from Ethyl Corporation; bromo chloro paraffin available as DD-8207 from Dover Corporation, poly[penta bromobenzyl]acrylate available as FR-1025 from Dead Sea Bromine Corporation; brominated epoxy resin available as Thermoguard 212 from M&T Corporation; and which blend is present on the front side of the substrate of the multilayered transparency of the present invention in any effective thickness. Typically, the total thickness of this first coating layer is from about 0.1 to about 25 microns and preferably from about 0.5 to 10 microns, although the thickness can be outside of these ranges. In the first coating composition, binder or mixtures thereof can be present within the coating in any effective amount; typically the binder or mixtures thereof are present in amounts of from about 5 parts by weight to about 95 parts by weight and the fire retardant materials are present from about 95 parts by weight to about 5 parts by weight; and a second ink receiving coating layer which comprises a blend of a hydrophilic polymer such as methyl cellulose (Methocel AM 4, available from Dow Chemical Company), hydroxypropyl hydroxyethyl cellulose available from Aqualon Company, and the like; ink spreading agents such as poly(ethylene oxide), such as POLY OX WSRN-3000 available from Union Carbide Corporation, ethylene oxide/propylene oxide copolymers, such as ethylene oxide/propylene oxide/ethylene oxide triblock copolymer, such as Alkatronic EGE-31-1 available from Alkaril Chemicals, dihydroxy benzoic acid (Aldrich 12,620-9, D10,940-1, 14,935-7, D10,960-6, D10,980-0, D11,000-0); 3,4-dihydroxy cinnamic acid (Aldrich D11,080-9), 3,4-dihydroxy hydro cinnamic acid (Aldrich 10,260-1), D,L-3,4-dihydroxy mandelic acid (Aldrich 15,161-0); 3,5-dihydroxy-4-methyl benzoic acid hemihydrate (Aldrich 31,848-S); cationic component monomeric such as tetra methyl ammonium bromide (Aldrich 19,575-8), tetra methyl ammonium chloride (Aldrich T1,952-6), and tetra methyl ammonium iodide (Aldrich 23,594-6); or polymeric such as polymethyl acrylate trimethyl ammonium chloride, such as HX42-1 available from Interpolymer Corporation, Mirapol, AD-1 AZ-1 available from Miranol, Incorporated, capable of complexing with the anionic dyes of the ink composition and a lightfastness inducing agent, such as poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company), 2-dodecyl-N-(2,2,6,6-tetramethyl-4-piperidinyl) succinimide (Cyasorb UV-3581, #41,317-8, available from Aldrich Chemical Company), 2-dodecyl-N-(1,2,2,6,6-pentamethyl-4-piperidinyl) succinimide (Cyasorb UV-3604, #41,318-6, available from Aldrich Chemical Company), and/or mixtures thereof, and a filler, such as colloidal silica, and a biocide, such as cationic poly(oxyethylene (dimethylamino) -ethylene (dimethylamino) ethylene dichloride) (Busan 77 available from Buckman Laboratories Inc.), and a cationic blend of methylene bisthiocyanate and dodecyl guanidine hydrochloride (available as Slime-Trol RX-31, RX-32, RX-32P, RX-33 from Betz Paper Chem Inc.).

One embodiment of the present invention includes a transparency with a first layer coating in a thickness of 10 microns, and comprised of 75 parts by weight of the polycarbonate, such as #035, having a melting point of 257° C. and available from Scientific Polymer Products, and 25 parts by weight of the heat and fire retardant material ethylene bis-tetrabromo phthalimide available as Saytex BT-93 from Ethyl Corporation, and a second 10 micron thick ink receiving layer comprised of a binder hydroxypropyl hydroxyethyl cellulose available from Aqualon Company present in amounts of 40 parts by weight, the ink spreading agent, 2,5-dihydroxy benzoic acid, Aldrich 14,935-7, present in an amount of 20 parts by weight, the cationic dye or dye mordant complexing component polymethyl acrylate trimethyl ammonium chloride, such as HX42-1 available from Interpolymer Corporation, present in an amount of 25 parts by weight, the lightfastness inducing agent such as poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company) present in amounts of 10 parts by weight, filler of colloidal silica present in amounts of 0.5 part by weight, and the biocide poly(oxyethylene (dimethylamino)-ethylene (dimethylamino) ethylene dichloride) (Busan 77 available from Buckman Laboratories Inc.) present in amounts of 4.5 parts by weight. This transparency has a haze value of about 3, lightfast values of about 95 percent and waterfastness of greater than about 75 percent.

Examples of the first layer binder polymers in contact with both lateral surfaces of the substrate include hydrophobic polymers such as vinyl alcohol-vinyl acetate copolymers, such as #379 available from Scientific Polymer Products, vinyl chloride-vinyl acetate-vinyl alcohol terpolymers, such as #064, #427, #428 available from Scientific Polymer Products, vinyl chloride-vinylidene chloride copolymers, such as #058 available from Scientific Polymer Products, vinylidene chloride-acrylonitrile copolymers, such as #395, #396 available from Scientific Polymer Products; cellulose acetate hydrogen phthalate, such as #085 available from Scientific Polymer Products, hydroxypropylmethyl cellulose phthalate, such as HPMCP available from Shin-Etsu Chemical, hydroxypropyl methyl cellulose succinate, such as HPMCS available from Shin-Etsu Chemical, cellulose triacetate, such as #031 available from Scientific Polymer Products, cellulose acetate butyrate, such as #077 available from Scientific Polymer Products, styrene-allyl alcohol copolymers, such as #393, #394 available from Scientific Polymer Products; poly(methylmethacrylate), such as #037A available from Scientific Polymer Products, poly(phenyl methacrylate), such as #227 available from Scientific Polymer Products, polycarbonates, such as 035 available from Scientific Polymer Products, polyester latex, such as Eastman AQ 29D available from Eastman Chemical Company, vinyl chloride latex, such as Geon 352 from B.F. Goodrich Chemical Group, polystyrene latex, such as DL6622A, DL6688A, and DL6687A from Dow Chemical Company, butadiene-acrylonitrile-styrene terpolymer latex, such as Tylac synthetic rubber latex 68-513 available from Reichhold Chemicals Inc., and mixtures thereof.

The first coating contains fire retardant component including (A) brominated polystyrene, available as Pyrochek LM, Pyrochek 60 PB, Pyrochek 68PB from Ferro Corporation; poly[penta bromobenzyl]acrylate, available as FR-1025 from Dead Sea Bromine Corporation; brominated polyesters; brominated epoxy resin, available as Thermoguard 212 from M&T Corporation; brominated paraffin, available as DD-8126 from Dover Corporation; bromo chloro paraffin, available as DD-8207 from Dover Corporation; bromo chloro paraffin with phosphorus, available as DD-8307 from Dover Corporation; chloro paraffin, available as Flexchlor 0002, Flexchlor 0008, Flexchlor 0023, available from Witco/Argus Corporation; condensed bromoacenaphthylene, available as Con-BACN from Tosoh Corporation; dibromoethyl dibromo cyclohexane, available as Saytex BCL-462 from Ethyl Corporation; dibromophenol, available as Emery 9331 from Henkel/Emery Corporation; dibromo neopentyl glycol, available as Emery 9336 from Henkel/Emery Corporation; 2,4,6-tribromophenol, available as Emery 9332 from Henkel/Emery Corporation; tetrabromo bisphenol A, available as Emery 9350 from Henkel/Emery Corporation; tetrabromo bisphenol A di-2 hydroxyethyl ether, available as BA-50, BA-50P from Great Lakes Corporation; tetrabromo bisphenol A diacrylate, available as Sartomer 640 from Sartomer Corporation; tetrabromo xylene, available as Emery 9345 from Henkel/Emery Corporation; pentabromo toluene, available as Saytex-105 from Ethyl Corporation; bis [tribromophenoxy] ethane, available as FF-680 from Great Lakes Corporation; bis[penta bromo phenoxy] ethane, available as 77B from Ferro Corporation; pentabromo diphenyloxide, available as FR-1205 from Dead Sea Bromine Corporation; pentabromo diphenyloxide/aromatic phosphate, available as DE-60F from Great Lakes Corporation; octabromo diphenyloxide, available as FR-1208 from Dead Sea Bromine Corporation; decabromo diphenyloxide, available as FR-1210 from Dead Sea Bromine Corporation; hexa bromo cyclododecane, available as Saytex-HBCD from Ethyl Corporation; tetradecabromo diphenoxy benzene, available as Saytex-120 from Ethyl Corporation; hexabromo cyclododecane tribromoallyl ether, available as FR-913 from Dead Sea Bromine Corporation; ethylene bis-tetrabromo phthalimide, available as Saytex BT-93, Saytex BT-93D from Ethyl Corporation; ethylene bis dibromo nobornane dicarboximide, available as Sayrex BN-451 from Ethyl Corporation; 1,2,3,4,7,8,9,10,13,13,14,14-dodeca chloro-1,4:7,10-dimethanodibenzo(a,e)cyclooctene, available as Dechlorane plus 25, Dechlorane plus 515, Dechlorane plus 2520 from Occidental Corporation; pentabromo chloro cyclohexane, available as FR-651-A from Dow Chemicals; (B) ammonium phosphate, available as Amgard CHT; dimelamine phosphate, available as Amgard ND; melamine phosphate, available as Amgard NH; ammonium polyphosphate, available as Amgard PI from Albright & Wilson Corporation; tributyl phosphate, available as Pliabrac TBP, and tricresyl phosphate, available as Pliabrac TCP from Merrand Corporation; triphenyl phosphate, available as Disflamoll TP, trixylenyl phosphate, available as Disflamoll TXP, trichloroethyl phosphate, available as Disflamoll TCA from Mobay Corporation; tributoxyethyl phosphate, available as Kronitex, KP-140 from F.M.C. Corporation; diphenyl cresyl phosphate, available as Disflamoll DPK, diphenyl octyl phosphate, available as Disflamoll DPO from Mobay Corporation; brominated triaryl phosphate, available as Kronitex PB-460 from F.M.C. Corporation; fatty alcohol polyglycol phosphate, available as Rewophat TD 70 from Rewo GmbH Corporation; tetrakis (2-chloroethyl) ethylene phosphate, available as Thermolin 101 from Olin Corporation; (C) inorganic compounds, such as magnesium carbonate, available as Elastocarb Tech Light, Elastocarb Tech High from Morton International Corporation; magnesium hydroxide, available as Versamag B-16, Versamag DC, Versamag SB, Versamag UF from Morton International Corporation, antimony oxide, available as Harshaw-HFR-201 from M&T.Harshaw Corporation; zinc borate, available as Firebrake ZB from U.S. Borax Corporation; alumina trihydrate, available as Haltex 300 from Hitox Corporation; semicalcined silica-alumin available as sillum-200; sillum-200Q/P, available as sillum PL-200, all from D.J. Enterprises; silicone fluid SFR-100 available from G.E. Corporation; and mixtures thereof.

Examples of the second ink receiving layer situated on the top of the first fire retardant layer in contact with the substrate include water soluble polymers such as (a) hydrophilic polysaccharides and their modifications, such as (1) alkyl celluloses (such as methyl cellulose (Methocel AM 4, available from Dow Chemical Company); (2) hydroxy alkyl celluloses, such as hydroxyethyl cellulose (Natrosol 250 LR, available from Hercules Chemical Company), and hydroxypropyl cellulose (Klucel Type E, available from Hercules Chemical Company); (3) alkyl hydroxy alkyl celluloses, such as ethyl hydroxyethyl cellulose (Bermocoll, available from Berol Kem. A.B. Sweden); (4) hydroxy alkyl alkyl celluloses, such as hydroxyethyl methyl cellulose (HEM, available from British Celanese Ltd., also available as Tylose MH, MHK from Kalle A.G.), hydroxypropyl methyl cellulose (Methocel K35LV, available from Dow Chemical Company), and hydroxy butylmethyl cellulose (such as HBMC, available from Dow Chemical Company); (5) dialkylammonium halide hydroxy alkyl cellulose, such as diethylammonium chloride hydroxy ethyl cellulose, available as Celquat H-100, L-200 from National Starch and Chemical Company; (6) hydroxyalkyl trialkyl ammonium halide hydroxyalkyl cellulose, such as hydroxypropyl trimethyl ammonium chloride hydroxyethyl cellulose, available from Union Carbide Company as Polymer JR; (7) carboxy alkyl cellulose salts, such as sodium carboxymethyl cellulose CMC 7HOF, available from Hercules Chemical Company; (8) cellulose sulfate salts, such as sodium cellulose sulfate #023 available from Scientific Polymer Products; (9) carboxyalkylhydroxyallcyl cellulose salts, such as sodium carboxymethylhydroxyethyl cellulose CMHEC 43H and 37L available from Hercules Chemical Company; (10) poly (vinyl alcohol), such as Elvanol available from DuPont Chemical Company; (11) poly(vinyl pyrrolidone) such as those PVP K-15, PVP K-300 PVP K-60, PVP K-90, available from GAF Corporation; (12) poly(vinyl alcohol) alkoxylated; (13) polyester latex, such as Eastman AQ 29D available from Eastman Chemical Company; (14) acrylic-vinyl acetate copolymer emulsions, such as Rhoplex AR-74 from Rohm and Haas Company; (15) vinyl acrylic terpolymer latex, such as 76 RES 3103 from Union Oil Chemical Division; (16) acrylic emulsion latex, such as Rhoplex B-15J, Rhoplex P-376 from Rohm and Haas Company; (17) poly(acrylamide), such as #02806 available from Poly Sciences Inc.; (18) acrylamide-acrylic acid copolymers, such as #04652, #02220, and #18545 available from Poly Sciences Inc.; and (19) poly(N,N-dimethyl acrylamide), such as #004590, available from Poly Sciences Inc.

The ink spreading components of the second ink receiving layer of the present invention include poly(ethylene oxide), such as POLY OX WSRN-300, available from Union Carbide Corporation, ethylene oxide/propylene oxide/ethylene oxide triblock copolymer, such as Alkatronic EGE-31-1, propylene oxide/ethylene oxide/propylene oxide triblock copolymers, such as Alkatronic PGP 3B-1, both available from Alkaril Chemicals, epichlorohydrin-ethyleneoxide copolymer, such as #155 available from Scientific Polymer Products, as well as mixtures thereof; acid compounds such as (a) amino acids compounds having both an amine functional group and an acid functional group such as 2-aminobutyric acid $CH_3(CH_2)CH(NH_2)COOH$ (Aldrich 16,266-3); 2,3-diamino propionic acid monohydrochloride $H_2NCH_2CH(NH_2)COOH.HCl$ (Aldrich 21,963-0); glycine $H_2NCH_2COOH$ (Aldrich G620-1) 4-acetamido benzoic acid $CH_3CONHC_6H_4COOH$ (Aldrich 13,333-7); sulfamic acid $H_2NSO_3H$ (Aldrich 24,278-0); 2-amino ethyl dihydrogen phosphate $H_2NCH_2CH_2OP(O)(OH)_2$ (Aldrich 29,286-9); (b) hydroxy acid compounds having both a hydroxy functional group and an acid functional group, such as 10-hydroxydecanoic acid $HO(CH_2)_9COOH$ (Aldrich 28,421-1); 3-hydroxybutyric acid $CH_3CH(OH)CH_2COOH$ (Aldrich H2,220-5); dihydroxy benzoic acid $(HO)_2C_6H_3COOH$ (Aldrich 12,620-9, D10,940-1, 14,935-7, D10,960-6, D10,980-0, D11,000-0); 3,4-dihydroxy cinnamic acid $(HO)_2C_6H_3CH{=}CHCOOH$ (Aldrich D11,080-9); 3,4-dihydroxy hydro cinnamic acid $(HO)_2C_6H_3CH_2CH_2COOH$ (Aldrich 10,260-1); (c) polycarboxyl compounds having at least two carboxyl functional groups including such as adipic acid $HOOC(CH_2)_4COOH$ (Aldrich 24,052-4); homophthalic acid $HOOCCH_2C_6H_4COOH$ (Aldrich H1,620-5); terephthalic acid $C_6H_4$-1,4-$(COOH)_2$ (Aldrich 18,536-1); phthalic acid $C_6H_4$-1,2-$(COOH)_2$ (Aldrich P3,930-3); and mixtures thereof, as those disclosed in copending application U.S. Ser. No. 196,679, the disclosure of which is totally incorporated herein by reference.

The second layer coating of the transparencies of the present invention contains lightfastness compositions comprised of two components, such as a UV absorbing compound and an antioxidant compound, and in embodiments three components, such as a UV absorbing compound, an anti oxidant compound and an antiozonant compound.

Further, the second layer coating of the transparencies of the present invention contains lightfastness inducing agents including UV absorbing compounds like octyl dimethyl amino benzoate, available as Escalol 507 from Van Dyk Corporation; hexadecyl 3,5-di-tert-butyl-4-hydroxybenzoate, available as Cyasorb UV-2908, #41,320-8, from Aldrich Chemical Company; octyl salicylate, available as Escalol 106 from Van Dyk Corporation; octyl methoxy cinnamate, available as Parasol MCX from Givaudan Corporation; 2-hydroxy-4-methoxy benzophenone, available as Anti UVA from Acto Corporation; 2,2'-dihydroxy-4,4'-dimethoxy benzophenone, available as Uvinul D 49, #D11,100-7, from Aldrich Chemical Company; 2-hydroxy-4-(octyloxy)benzophenone, available as Cyasorb UV-531, #41,315-1, from Aldrich Chemical Company; 2-hydroxy-4-dodecyloxy benzophenone, available as DOBP from Eastman Chemicals; 2-(2'-hydroxy-5'-methylphenyl) benzotriazole, available as Tinuvin 900 from Ciba Geigy Corporation; 2-[2'-hydroxy-3,5-di-(1,1-dimethyl benzyl) phenyl]-2H-benzotriazole, available as Topanex 100BT from ICI America Corporation; bis[2-hydroxy-5-tert-octyl-3-(benzotriazol-2-yl) phenyl methane, available as Mixxim BB/100 from Fairmount Corporation; 2-(4-benzoyl-3-hydroxyphenoxy)ethylacrylate (Cyasorb UV-416, #41,321-6, available from Aldrich Chemical Company), poly[2-(4-benzoyl-3-hydroxyphenoxy) ethylacrylate](Cyasorb UV-2126, #41,323-2, available from Aldrich Chemical Company), tris(3,5-di-tert-butyl-4-hydroxybenzyl) isocyanurate, available as Good-rite UV 3114 from Goodrich Chemicals; [2,2,6,6-tetramethyl-4-piperidinyl)-1,2,3,4-butane tetra carboxylate, available as Mixxim HALS 57 from Fairmount Corporation; [2,2,6,6-tetramethyl-4-piperidinyl/β,β,β',β'-tetramethyl-3,9-(2,4,8,10-tetraoxospiro (5,5) undecane) diethyl]-1,2,3,4-butane tetracarboxylate, available as Mixxim HALS 68 from Fairmount Corporation; [1,2,2,6,6-pentamethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 63,from Fairmount Corporation; 2-dodecyl-N-(2,2,6,6-tetramethyl-4-piperidinyl) succinimide, available as Cyasorb UV-3581, #41,317-8, from Aldrich Chemical Company; 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)2-dodecyl succinimide, available as Cyasorb UV-3668, #41,319-4, from Aldrich Chemical Company; tetrasodium N-(1,2-dicarboxyethyl)-N-octadecyl sulfosuccinamate, available as Aerosol 22N from American Cyanamid Corporation; nickel dibutyldithiocarbamate, available as UV-Chek AM-105 from Ferro Corporation; poly(3,5-di-tert-butyl-4-hydroxyhydrocinnamicacid ester/1,3,5-tris(2-hydroxyethyl)-5-triazine-2,4,6(1H,3H,5H)-trione, available as Good-rite 3125 from Goodrich Chemicals; poly[N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0, from Aldrich Chemical Company; and 1-[N-[poly(3-allyloxy-2-hydroxypropyl)-2-aminoethyl]-2-imidazolidinone, #41,026-8, available from Aldrich Chemical Company.

Further, the second layer ink receiving coating of the transparencies of the present invention contains lightfastness inducing antioxidant compounds such as didodecyl 3,3'-thiodipropionate, available as Cyanox, LTDP, #D12,840-6, from Aldrich Chemical Company; ditridecyl 3,3'-thiodipropionate, available as Cyanox 711, #41,311-9, from Aldrich Chemical Company); ditetradecyl 3,3'-thiodipropionate, available as Cyanox, MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox, STDP, #41,310-0, from Aldrich Chemical Company; triethyleneglycol bis[3-(3'-tert-butyl-4'-hydroxy-5'-methylphenyl)propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis [methylene(3,5-di-tert-butyl-4-hydroxy hydrocinnamate)], available as Irganox 1010 from Ciba-Geigy Corporation; thiodiethylene bis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N'-hexamethylene bis(3,5-di-tert-butyl-4-hydroxy hydrocinnamide), available as Irganox 1098 from Ciba-Geigy Corporation; 2,2-bis[4-(2-(3,5-di-tert-butyl-4-hydroxyhydrocinnamoyloxy))ethoxy phenyl] propane, available as Topanol 205 from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox I(B from Mobay Chemicals; 2,6-di-tert-butyl-α-dimethylamino-ρ-cresol, available as Ethanox 703 from Ethyl Corporation; 2,2'-isobutylidene-bis(4,6-dimethyl phenol), available as Vulkanox NKF from Mobay Chemicals; 2,2'-methylene bis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LE65 from Harcros Corporation; tris(nonyl phenyl) phosphite, available as Lankromark LE109 from Harcros Corporation; tris(2,4-di-tert-butyl-phenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-ρ-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622 from Vanderbilt Corporation; molybdenum oxysulfide dithio carbamate, available as Vanlube 622 from Vanderbilt Corporation; 2,2,4-trimethyl-1,2-hydroquinoline, available as Vulkanox HS from Mobay Corporation; and mixtures thereof.

The second layer ink receiving coating of the transparencies of the present invention contains lightfastness inducing antiozonants such as N-isopropyl-N'-phenyl-phenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis (1,4-dimethyl pentyl) -ρ-phenylene diamine, available as Santoflex 77 from Monsanto Chemicals; 2,4,6-tris-(N-1,4-dimethyl pentyl-ρ-phenylene diamino)-1,3,5-triazine, available as Durazone 37 from Uniroyal Corporation; 6-ethoxy-1,2-dihydro-2,2,4-trimethyl quinoline, available as Santoflex AW from Monsanto Chemicals; bis-(1,2,3,6-tetrahydrobenzaldehyde) pentaerythritol acetal, available as Vulkazon AFS/LG from Mobay Corporation; paraffin wax, available as Petrolite C-700, Petrolite C-1035 from Petrolite Corporation; and mixtures thereof.

The second layer ink receiving coating of the present invention contains dye immobilizing cationic monomeric or polymeric components capable of complexing with the dyes in the ink compositions used to develop transparencies. Examples of suitable dye immobilizing cationic components include quaternary ammonium block copolymers, such as Mirapol A-15 and MirapoL WT, available from Miranol, Incorporated, Dayton, N.J., prepared as disclosed in U.S. Pat. No. 4,157,388, the disclosure of which is totally incorporated herein by reference, Mirapol AZ-1, available from Miranol, Inc., prepared as disclosed in U.S. Pat. No. 4,719,282, the disclosure of which is totally incorporated herein by reference, Mirapol AD-1, available from Miranol, Inc., prepared as disclosed in U.S. Pat. No. 4,157,388, Mirapol 90 Mirapol 95, and Mirapol 175 available from Miranol, Inc., Dayton, N.J., prepared as disclosed in U.S. Pat. No. 4,719,282, and the like. Other suitable cationic dye mordants comprise diamino alkanes, quaternary salts, or quaternary acrylic copolymer latexes.

Also, suitable dye immobilizing cationic monomeric or polymeric components capable of complexing with the dyes in the ink compositions used to develop transparencies are monoammonium compounds as disclosed in, for example, U.S. Pat. No. 5,320,902, the disclosure of which is totally incorporated herein by reference, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), N-cetyl, N-ethyl morpholinium ethosulfate (G-263, ICI Americas).

Also, suitable cationic components monomeric or polymeric capable of complexing with dyes contained in the ink compositions are phosphonium compounds, such as, for example, those disclosed in copending application U.S. Ser. No. 08/034,917, the disclosure of which is totally incorporated herein by reference, including bromomethyl triphenyl phosphonium bromide (Aldrich 26, 915-8), [3-hydroxy-2-methyl propyl] triphenyl phosphonium bromide (Aldrich 32,507-4), 2-tetra phenyl phosphonium bromide (Aldrich 21,878-2), tetra phenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of materials suitable as dye immobilizing cationic components, monomeric or polymeric, capable of complexing with the dye contained in an ink jet ink composition used to develop transparencies include those disclosed in copending application Ser. No. 08/034,917, and U.S. Pat. No. 5,457,486, U.S. Pat. No. 5,314,747, U.S. Pat. No. 5,320,902, and U.S. Pat. No. 5,441,795, the disclosures of each of which are totally incorporated herein by reference.

Examples of the second ink receiving layer filler components include hollow microspheres Eccospheres MC-37 (sodium borosilicate glass), Ucar BJ0-0930 (phenolic polymers, available from Union Carbide); Miralite 177 (vinylidene chloride-acrylonitrile, available from Pierce & Stevens Chemical Corporation); and the like. Examples of solid microspheres include Spheriglass E250P2 and 10002A (soda-lime glass A-glass, E-glass), available from Potters Industries. Further information regarding microspheres is disclosed in, for example, *Encyclopedia of Polymer Science and Engineering*, vol. 9, p. 788 et seq., John Wiley and Sons (New York 1987), the disclosure of which is totally incorporated herein by reference, sodium metasilicate anhydrous available as Drymet 59, from Crossfield Chemicals, Incorporated, sodium metasilicate pentahydrate Crystamet 1020, Crystamet 2040, Crystamet 3080, from Crossfield Chemicals, Incorporated; magnesium oxide, available as Elastomag 100, Elastomag 100 R, Elastomag 170, Elastomag 170 micropellet, zirconium oxide (SF-EXTRA available from Z-Tech Corporation), colloidal silicas, such as Syloid 74, available from Grace Company, titanium dioxide (available as Rutlie or Anatase from NL Chem Canada, Inc.), calcium carbonate (Microwhite Sylacauga Calcium Products), zinc oxide, such as Zoco Fax 183 available from Zo Chem, barium titanate, #20,810-8 available from Aldrich Chemicals, antimony oxide #23,089-8 available from Aldrich Chemicals, and the like, and mixtures thereof.

Examples of suitable biocides of the second ink receiving layer include (A) nonionic biocides, such as 2-bromo-4'-hydroxyacetophenone (Busan 90, available from Buckman Laboratories); 3,5-dimethyl tetrahydro-2H-1,3,5-thiadiazineo2-thione (Slime-Trol RX-28, available from Betz Paper Chem Inc.; (a nonionic blend of 5-chloro-2-methyl-4-isothiazoline-3-one, 75 percent by weight, and 2-methyl-4-isothiazolin-3-one, 25 percent by weight), (available as Amerstat 250 from Drew Industrial Division; Nalcon 7647 from Nalco Chemical Company; Kathon LX from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33 percent by weight, sodium dimethyldithiocarbamate, 33 percent by weight, and sodium ethylene bisdithiocarbamate, 33 percent by weight, (available as Amerstat 282 from Drew Industrial Division; AMA-131 from Vinings Chemical Company); (6) sodium dichlorophene (G-4-40 available from Givaudan Corporation); and the like, as well as mixtures thereof; (C) cationic biocides, such as cationic poly(oxyethylene (dimethylamino)-ethylene (dimethylamino) ethylene dichloride) (Busan 77 available from Buckman Laboratories Inc.); (3) a cationic blend of bis(trichloromethyl) sulfone and a quaternary ammonium chloride (available as Slime-Trol RX-36 DPB-865 from Betz Paper Chem. Inc.); and the like, as well as mixtures thereof. The biocide can be present in any effective amount; typically, the biocide is present in an amount of from about 0.1 percent by weight to about 3 percent by weight of the coating, although the amount can be outside this range.

The coatings of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° C. to about 100° C. in an air dryer.

The drying time of images obtained with the transparencies of the present application is the time for zero image-offset and can be measured as follows: a line comprising different color sequences is drawn on the transparency with droplets of inks from an ink jet printhead moving from left to right and back. Thereafter, this image is purposely smeared with the pinch roll of the printer by fast forwarding the transparency mechanically while the pinch roll is on the top of the imaged line. This entire procedure takes about two seconds to complete. In the event that no offset of the printed image on the unprinted paper or transparency occurs, the drying time of the image is considered as less than two seconds.

Transparencies of the present invention in embodiments exhibit reduced curl upon being printed with aqueous inks, particularly in situations wherein the ink image is dried by exposure to microwave radiation. Generally, the term curl refers to the distance between the base line of the arc formed by the transparency or recording sheet when viewed in cross-section across its width (or shorter dimension, for example, 8.5 inches in an 8.5×11 inch sheet, as opposed to length, or longer dimension, for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The transparencies of the present invention in embodiments exhibit little or no blocking. Blocking refers to the transfer of ink or toner from a printed image from one sheet to another when recording sheets are stacked together. The recording sheets of the present invention exhibit substantially no blocking under, for example, environmental conditions of from about 20 to about 80 percent relative humidity and at temperatures of about 80° F.

Further, the transparencies of the present invention in embodiments exhibit high resistance to humidity. Resistance to humidity generally is the capacity of a recording sheet to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Haze values recited herein were measured by a XL-211 Hazegard Hazemeter supplied by Pacific Scientific Company.

The lightfastness values of the ink jet images were measured in the Mark V Lightfastness Tester obtained from Microscal Company, London, England.

Specific embodiments of the invention will now be described in detail. These Examples are intended to be illustrative, and the invention is not limited to the materials, conditions, or process parameters set forth in these embodiments. The coatings, a total of four, are included on both surfaces or sides of the transparency unless otherwise indicated. All parts and percentages are by weight unless otherwise indicated.

EXAMPLE I

Twenty transparency sheets were prepared by the solvent extrusion process (single side each time initially) on a Faustel Coater using a one slot die by providing for each a MYLAR™ base sheet (roll form) with a thickness of 100 microns, and coating the front side of the base sheet with a hydrophilic ink receiving layer comprised of a blend of 50 parts by weight of binder polyvinyl alcohol, 88 percent hydrolyzed, available as Airvol 540-S from Air Products Company, 20 parts by weight of ink spreading compound 3,5-dihydroxy benzoic acid (Aldrich #D11,000-0) and 24.9 parts by weight of the dye immobilizing cationic component polymethyl acrylate trimethyl ammonium chloride latex, HX42-1 available from Interpolymer Corporation, 3.0 parts by weight of lightfastness UV compound poly[N,N-bis(2,2,6,6-tetramethyl-4-piperidinyl)-1,6-hexanediamine-co-2,4-dichloro-6-morpho lino-1,3,5-triazine) (Cyasorb UV-3346, #41,324-0, available from Aldrich Chemical Company) and 2.0 parts by weight of the antioxidant/antiozonant didodecyl 3,3'-thiodipropionate, 0.1 part by weight of the filler colloidal silica, available as Syloid 74 from W.R. Grace and Company, which blend was present in a concentration of 10 percent by weight in water. Subsequent to air drying at 100° C. and monitoring the difference in weight prior to and subsequent to coating, the dried MYLAR™ base sheet rolls contained 1.0 gram in a thickness of 10 microns of the ink receiving layer. Rewinding the coated side of the MYLAR™ base sheet (roll form) on to an empty core and using these rolls, the uncoated back side of the MYLAR™ base sheet was coated on a Faustel Coater using a one slot die with the same ink receiving layer as that on the front side. The transparency sheets thus prepared had a haze value of 3.

The above prepared transparencies were printed with a Xerox Corporation ink jet test fixture equipped with a microwave dryer and containing inks of the following compositions to, for example, determine check print quality, drying times of the images, lightfastness and waterfastness.

Cyan 15.75 Percent by weight of sulfolane, 12.0 percent by weight of butyl carbitol, 2.0 percent by weight of ammonium bromide, 13.0 percent by weight acetylethanolamine, 0.015 percent by weight of ammonium hydroxide, 0.05 percent by weight of polyethylene oxide (molecular weight 18,500) obtained from Union Carbide Company, 22.5 percent by weight of Projet Cyan 1 dye solution obtained from Zenca Colors, 18.75 percent by weight of Projet blue OAM dye solution obtained from Zenca Colors and 15.935 percent by weight of deionized water.

Magenta 15.75 Percent by weight of sulfolane, 12.0 percent by weight of butyl carbitol, 2.0 percent by weight of ammonium bromide, 13.0 percent by weight acetylethanolamine, 0.03 percent by weight of ammonium hydroxide, 0.05 percent by weight of DOWICIL 150™ biocide obtained from Dow Chemical Company, Midland, MI, 0.05 percent by weight of polyethylene oxide (molecular weight 18,500) obtained from Union Carbide Company, 25 percent by weight of Projet Magenta 1T dye solution obtained from Zenca Colors, 6.0 percent by weight of Acid Red 52 solution obtained from Tricon Colors, and 26.12 percent by weight of deionized water.

Yellow 15.75 Percent by weight of sulfolane, 12.0 percent by weight of butyl carbitol, 13.0 percent by weight acetylethanolamine, 2.0 percent by weight of ammonium bromide, 0.03 percent by weight of ammonium hydroxide, 0.05 percent by weight of DOWICIL 150™ biocide obtained from Dow Chemical Company, Midland, Mich., 0.05 percent by weight of polyethylene oxide (molecular weight 18,500) obtained from Union Carbide Company, 27.0 percent by weight of Projet Yellow 1G dye (7.5 percent solution) obtained from Zeneca Colors, 20.0 percent by weight of Acid Yellow 17 solution obtained from Tricon Colors, and 10.12 percent by weight of deionized water.

Black 20.0 Percent by weight of sulfolane (Aldrich T2,220-9), 5.0 percent by weight of pantothenol, (Aldrich 29,578-7), 5.0 percent by weight of 1,4-bis(2-hydroxyethoxy)-2-butyne (Aldrich B4,470-8), 5.0 percent by weight of 2,2'-sulfonyl diethanol (Aldrich 18,008-4) obtained from Aldrich Chemical Company, 0.05 percent by weight of Dowicil 150™ biocide obtained from Dow Chemical Company, Midland, Mich., 0.05 percent by weight of polyethylene oxide (molecular weight 18,500) obtained from Union Carbide Company, 7.0 percent by weight Carbon Black Levanyl A-SF [25.0 milliliters of predispersed Carbon Black Levanyl A-SF dispersion containing 28.0 percent solids of Carbon Black and 6.0 percent dispersant] obtained from Bayer A.G of Germany and 39.90 percent by weight of deionized water.

Images with 100 percent ink coverage were generated by printing block patterns for magenta, cyan, yellow, and black. These images were dried with a microwave dryer operated at 2.45 GHz frequency using serpentine waveguide mode for periods of one second and two seconds by adjusting the dryer speed.

At dryer speed of 4.33 inches per second (resident time of one second in the dryer) the resulting images yielded optical density values of 2.00 black, 1.80 cyan, 1.60 magenta and 1.00 yellow. These images had lightfastness values of greater than 95 percent and, more specifically, about 98 percent average for all colors after a period of six months, and showed no intercolor bleed when retained at a 80 percent humidity at 80° F. for a period of seven days.

At dryer speed of 2.17 inches per second (resident time of two seconds in the dryer) the resulting overdried colored images evidenced undesirable image degradation primarily, it is believed, because of the crystallization of the dyes as observed by the presence of dark patches in the imaged colored areas during their projection on a 3M Model 905 Overhead Projector and the black area printed with the carbon black pigmented ink melted away in two seconds primarily because of excessive heat generated by the absorption of microwave energy by the Carbon Black pigmented inks.

EXAMPLE II

Twenty transparency sheets were prepared by the solvent extrusion process (single side each time initially) on a Faustel Coater using a one slot die by providing for each a MYLAR™ base sheet (roll form) with a thickness of 100 microns, and coating the front side of the base sheet with a hydrophobic heat dissipating/fire resistant coating comprised of 75 parts by weight of polycarbonate, #035, having a melting point of 257° C. and available from Scientific Polymer Products and 25 parts by weight of a heat dissipating fire retardant compound ethylene bis-tetrabromo phthalimide, available as Saytex BT-93 from Ethyl Corporation, which blend was present in a concentration of 5 percent by weight in dichloromethane. Subsequent to air drying at 100° C. and monitoring the difference in weight prior to and subsequent to coating, the dried MYLAR™ base sheet rolls contained 1.0 gram in a thickness of 10 microns of the hydrophobic heat dissipating and fire resistant coating. This hydrophobic heat dissipating/fire resistant coating was overcoated on a Faustel Coater using a one slot die with a hydrophilic ink receiving layer comprised of a blend of 50 parts by weight of polyvinyl alcohol, 88 percent hydrolyzed, available as Airvol 540-S from Air Products Company, 20 parts by weight of 305-dihydroxy benzoic acid (Aldrich #D11,000-0) and 24.9 parts by weight of the dye immobilizing cationic component polymethyl acrylate trimethyl ammonium chloride latex, HX42-1 available from Interpolymer Corporation, 3.0 parts by weight of poly[N,N-bis(2,2,6,6-tetramethyl-4-piperidinyl)-1,6-hexanediamine-co-2,4-dichloro-6-morpho lino-1,3,5-triazine) (Cyasorb UV-3346, #41,324-0, available from Aldrich Chemical Company), 2.0 parts by weight of didodecyl 3,3'- thiodipropionate, 0.1 part by weight of colloidal silica available as Syloid 74 from W.R. Grace and Company, which blend was present in a concentration of 10 percent by weight in water. Subsequent to air drying at 100° C. and monitoring the difference in weight prior to and subsequent to coating, the dried MYLAR™ base sheet rolls contained 1.0 gram in a thickness of 10 microns of the ink receiving layer. Rewinding the coated side of the MYLAR™ base sheet (roll form) on to an empty core and using these rolls, the uncoated back side of the MYLAR™ base sheet was coated first with the same hydrophobic heat/fire resistant coating that was present on the front side on a Faustel Coater using a one slot die which was further overcoated on a Faustel Coater using a one slot die with the same hydrophilic ink receiving layer as that on the front side. The transparency sheets thus prepared had a haze value of 3.

The above prepared transparencies were incorporated into a Xerox Corporation ink jet test fixture equipped with a microwave dryer and containing inks of the same compositions as in Example I to, for example, determine print quality, drying times of the images, their lightfastness and waterfastness.

Images with 100 percent ink coverage were generated by printing block patterns for magenta, cyan, yellow, and black. These images were dried with a microwave dryer operated at 2.45 GHz frequency using serpentine wave guide mode for periods of 1 second and two seconds, respectively, by adjusting the dryer speed.

At dryer speed of 4.33 inches per second (resident time of one second in the dryer) the resulting dried images yielded optical density values of 1.95 black, 1.70 cyan, 1.60 magenta and 0.9 yellow. These images had lightfastness values better than 90 percent and, more specifically, about 98 percent average for all colors after a period of six months, and showed no intercolor bleed when retained at a 80 percent humidity at 80° F. for a period of seven days.

At dryer speed of 2.17 inches per second (resident time of two seconds in the dryer) the resulting overdried colored images evidenced no image degradation due to the crystallization of dyes as observed by the absence of dark patches in the imaged colored areas during their projection on a 3M Model 905 Overhead Projector, and the black area printed with the carbon black pigmented ink did not melt away as the excessive heat generated by the absorption of microwave energy by the carbon black pigmented inks was dissipated over a wider area by the heat/fire resistant protective coating.

EXAMPLE III

Twenty sheets of Xerox® 4024 paper (internally acid sized but without any surface sizing) obtained from Domtar Paper Company (in roll form) in a thickness of 108 microns, with internal sizing of 68 seconds and a porosity of 915 milliliters per minute, were cut into sizes of 8.5×11.0 inches. These uncoated papers were incorporated into a Xerox Corporation ink jet test fixture equipped with a microwave dryer and containing pigmented black inks of the same composition as in Example I to, for example, determine fire resistance of the images.

Images with 100 percent ink coverage were generated by printing block patterns for the carbon black pigmented ink. These images were dried with a microwave dryer operated at 2.45 GHz frequency using serpentine waveguide mode for periods of one second and two seconds, respectively, by adjusting the dryer speed.

At dryer speed of 4.33 inches per second (resident time of one second in the dryer) the resulting dried images yielded optical density values of 1.45 black.

At dryer speed of 2.17 inches per second (resident time of two seconds in the dryer), the resulting overdried black area printed with the carbon black pigmented ink caught fire due to the excessive heat generated by the absorption of microwave energy by the carbon black pigmented inks.

EXAMPLE IV

Twenty coated papers were prepared by the solvent extrusion process (single side each time) on a Faustel coater by providing a substrate sheet of Xerox® 4024 paper (internally acid sized but without any surface sizing) obtained from Domtar Paper Company (in roll form) in a thickness of 108 microns, with internal sizing of 68 seconds and a porosity of 915 milliliters per minute, and coating these sheets with a fire/heat resistant coating layer composition comprising 30 parts by weight of semicalcined silica-alumina available as sillum-200Q/P from D.J.Enterprises; 20 parts by weight of alumina trihydrate, available as Haltex 300 from Hitox Corporation, 10 parts by weight of zinc borate available as Firebrake ZB from U.S. Borax Corporation, 10 parts by weight of antimony oxide available as Harshaw-HFR-201 from M&T.Harshaw Corporation, and 30 parts by weight of polyester latex, Eastman AQ 29D available from Eastman Chemical Company, which composition was present in a concentration of 40 percent by weight in water. Subsequent to air drying at 100° C. and monitoring the difference in weight prior to and subsequent to coating, the dried paper sheet rolls contained 0.3 gram in a thickness of 3 microns of the fire/heat resistant coating layer.

The above prepared coated papers were incorporated into a Xerox Corporation ink jet test fixture equipped with a microwave dryer and containing pigmented black ink of the same composition as in Example I to, for example, determine resistance to fire.

Images with 100 percent ink coverage were generated by printing block patterns for the carbon black pigmented ink. These images were dried with a microwave dryer operated at 2.45 GHz frequency using serpentine waveguide mode for periods of one second and two seconds, respectively, by adjusting the dryer speed.

At dryer speed of 4.33 inches per second (resident time of one second in the dryer) the resulting dried images yielded optical density values of 1.95 black.

At dryer speed of 2.17 inches per second (resident time of two seconds in the dryer) the resulting overdried black area printed with the carbon black pigmented ink did not catch fire since the excessive heat generated by the absorption of microwave energy by the carbon black pigmented inks.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A transparency comprised of a supporting substrate, and thereover two coatings, a first heat dissipating and fire resistant coating layer in contact with the substrate and wherein said first coating is comprised of a binder with a melting point in the range of from about 100° C. to about 275° C. and a heat dissipating fire retardant component, and a second ink receiving coating layer thereover comprising a blend of a hydrophilic binder polymer, an acid ink spreading agent, a cationic component, a lightfastness inducing agent, a filler, and a biocide.

2. A transparency in accordance with claim 1 wherein the lightfastness value of said transparency is from about 80 to about 98 percent.

3. A transparency in accordance with claim 1 wherein the first heat dissipating and fire resistant coating binder polymers are polycarbonates, polyesters, or vinyl chloride-vinylidene chloride copolymers; the heat and fire retardant components are ethylene bistetrabromo phthalimide, bromo chloro paraffin or poly[pentabromobenzyl]acrylate; the second ink receiving layer is comprised of a hydrophillic polymer of polyvinylalcohol or hydroxypropylmethylcellulose; the ink spreading agents of the ink receiving layer are 3,5-dihydroxy benzoic acid; the cationic component is a monomeric or polymeric component capable of complexing with the dyes contained in ink compositions, and which component is tetra methyl ammonium bromide, tetra phenyl phosphonium bromide, quaternary or acrylic copolymer latexes; the lightfastness component of the ink receiving layer is octyl dimethyl amino benzoate, 2,2'-dihydroxy-4,4'-dimethoxy benzophenone, or poly[N,N-bis(2,2,6,6-tetramethyl-4-piperidinyl)-1,6-hexanediamine-co-2,4-dichloro-6-morpholino-1,3,5-triazine]; the biocide of the ink receiving layer is cationic poly(oxyethylene (dimethylamino)-ethylene (dimethylamino) ethylene dichloride), or anionic potassium N-hydroxymethyl-N-methyl-dithiocarbamate; the fillers of the ink receiving layer are colloidal silica, hollow composite microspheres of polyvinylidene chloride-acrylonitrile copolymer shell, or microspheres of phenolic polymers, and which transparency possesses a haze value of from about 0.5 to about 10 and a lightfastness value of from about 95 to about 98.

4. A transparency in accordance with claim 1 wherein the heat dissipating and fire resistant coating layer is about 10 microns thick, the binder polymer is present in amounts of 75 parts by weight, the heat dissipating and fire retardant components are present in amounts of 25 parts by weight; and wherein the second ink receiving layer is of a thickness of about 10 microns, the hydrophilic binders are present in amounts of 40 parts by weight, the ink spreading agent is present in an amount of 20 parts by weight, the cationic dye complexing agent is present in an amount of 25 parts by weight, the lightfastness component is present in amounts of 10 parts by weight, the filler is present in amounts of 0.5 part by weight, the biocide is present in amounts of 4.5 parts by weight, and which transparency possesses a haze value of 3, a lightfastness value of about 98 percent, and waterfastness value of greater than 80 percent.

5. A transparency in accordance with claim 1 wherein the binder is polycarbonate present in an amount of 75 parts by weight, and the heat dissipating and fire retardant component is ethylene bis-tetrabromo phthalimide present in an amount of 25 parts by weight; and in the second ink receiving layer the binder is hydroxypropyl hydroxyethyl cellulose present in an amount of 40 parts by weight, the ink spreading agent is 2,5-dihydroxy benzoic acid present in an amount of 25 parts by weight, the cationic component is polymethyl acrylate trimethyl ammonium chloride present in an amount of 25 parts by weight, the lightfastness component contains the UV compound poly[N,N-bis(2,2,6,6-tetramethyl-4-piperidinyl)-1,6-hexanediamine-co-2,4-dichloro-6-morpholino-1,3,5-triazine] present in amounts of 3 parts by weight, the lightfastness component contains the antioxidant didodecyl 3,3'-thiodipropionate present in amounts of 1 part by weight, the lightfastness component further contains the antiozonant compound N,N'-bis(1,4-dimethyl pentyl)-ρ-phenylene diamine present in an amount of 1 part by weight, the filler is colloidal silica present in an amount of 0.5 part by weight, the biocide is poly (oxyethylene (dimethylamino)-ethylene (dimethylamino) ethylene dichloride) present in an amount of 4.5 parts by weight, and which transparency possesses a haze value of 3, a lightfastness values of about 98 percent, and a waterfastness value of 75 percent.

6. A transparency comprised of a supporting substrate, thereover and thereunder a first coating layer which dissipates heat and is substantially fire resistant, and which first coating is comprised of a binder with a melting point in the range of from about 100° C. to about 275° C. and a heat dissipating fire retardant component, and wherein said binder is present in amounts of from about 5 parts by weight to about 95 parts by weight and said fire retardant component is present in amounts of from about 95 parts by weight to about 5 parts by weight; and a second ink receiving coating layer situated thereover and thereunder the first heat dissipating and fire resistant layer, and which second coating is comprised of a blend of a binder polymer, an acid ink spreading component, a cationic component, a lightfastness component, a filler and a biocide.

7. A transparency in accordance with claim 6 wherein said lightfastness component is present in amounts of from about 15 parts by weight to about 2 parts by weight, the filler is present in amounts of from about 0.1 part by weight to about 50 parts by weight, and the biocide is present in amounts of from about 4.9 parts by weight to about 1 part by weight, and which transparency possesses a haze value of from about 0.5 to about 6 and a lightfastness value of from about 95 to about 98.

8. A transparency in accordance with claim 6 wherein the binder polymers of the first heat dissipating and fire resistant layer are vinyl alcohol-vinyl acetate copolymers, vinyl chloride-vinyl acetate-vinyl alcohol terpolymers, vinyl chloride-vinylidene chloride copolymers, cellulose acetate hydrogen phthalate, hydroxypropylmethyl cellulose phthalate, hydroxypropyl methyl cellulose, succinate, cellulose triacetate, cellulose acetate butyrate, styrene-allyl alcohol copolymers, poly(methylmethacrylate) poly (phenylmethacrylate), polycarbonates, a polyester latex, or a butadiene-acrylonitrile-styrene terpolymer latex present in amounts of from about 50 to about 95 parts by weight.

9. A transparency in accordance with claim 6 wherein the heat resistant and fire retarding compounds of the first layer are selected from the group consisting of halogenated polystyrene, poly[pentabromobenzyl]acrylate, halogenated epoxy resin, brominated paraffin, bromo chloro paraffin, bromo chloro paraffin with phosphorus, chloro paraffin, bromoacenaphthylene, dibromoethyl dibromo cyclohexane, dibromo neopentyl glycol, 2,4,6-tribromophenol, tetrabromo bisphenol A, tetrabromo bisphenol A di-2 hydroxyethyl ether, tetrabromo bisphenol A diacrylate, tetrabromo xylene, pentabromo toluene, bis[tribromophenoxy] ethane, bis[penta bromo phenoxy] ethane, pentabromo diphenyloxide, pentabromo diphenyloxide/aromatic phosphate, octabromo diphenyloxide, decabromo diphenyloxide, hexabromo cyclododecane, tetradecabromo diphenoxy benzene, hexabromo cyclododecane tribromoallyl ether, ethylene bis-tetrabromo phthalimide, ethylene bis-dibromonorbornane dicarboximide, 1,2,3,4,7,8,9,10,13,13,14,14-dodeca chloro-1,4:7,10-dimethanodibenzo(a,e) cyclooctene, pentabromo chloro cyclohexane, ammonium phosphate, dimelamine phosphate, melamine phosphate ammonium polyphosphate, tributyl phosphate, tricresyl phosphate, triphenyl phosphate, trixylenyl phosphate, trichloroethyl phosphate, tributoxyethyl phosphate, diphenyl cresyl phosphate, diphenyl octyl phosphate, fatty alcohol polyglycol phosphate, tetrakis(2-chloroethyl) ethylene phosphate, magnesium carbonate, magnesium hydroxide, antimony oxide, zinc borate, alumina trihydrate, semicalcined silica-alumina, silicone fluid, and mixtures thereof.

10. A transparency in accordance with claim 6 wherein the thickness of the first heat and fire resistant coating layer in contact with the substrate is from about 0.1 to about 25 microns.

11. A transparency in accordance with claim 6 wherein the second ink receiving layer situated on the top of the first heat and fire resistant layer is comprised of hydrophilic polymers selected from the group consisting of polysaccharides, vinyl polymers, latex polymers, acrylamide containing polymers, poly(ethylene oxide), epichlorohydrin-ethylene oxide copolymer, and mixtures thereof present in amounts of from about 10 to about 40 parts by weight.

12. A transparency in accordance with claim 6 wherein the ink spreading component of the ink receiving layer is selected from the group consisting of amino acids, hydroxy acids, and polycarboxyl compounds.

13. A transparency in accordance with claim 6 wherein the ink spreading component of the ink receiving layer is 2-aminobutyric acid, 4-acetamido benzoic acid, dihydroxy benzoic acid, 3,4-dihydroxy cinnamic acid, and phthalic acid.

14. A transparency in accordance with claim 6 wherein the cationic component is comprised of quaternary compounds selected from the group consisting of diethylammonium chloride hydroxy ethyl cellulose, hydroxypropyl trimethyl ammonium chloride hydroxyethyl cellulose, quaternary acrylic copolymer latexes, tetra methyl ammonium bromide, tetrahexadecyl ammonium bromide, tetra phenyl phosphonium bromide, phenacyl triphenyl phosphonium bromide present in amounts of from about 30 to about 3 parts by weight.

15. A transparency in accordance with claim 6 wherein the lightfastness component of the ink receiving layer is selected from the group consisting of octyl dimethyl amino benzoate, octyl salicylate, octyl methoxy cinnamate, 2-hydroxy-4-(octyloxy)benzophenone, 2-hydroxy-4-dodecyloxy benzophenone, bis[2-hydroxy-5-tert-octyl-3-(benzotriazol-2-yl) phenyl methane, 2-(4-benzoyl-3-hydroxyphenoxy) ethylacrylate, poly[2-(4-benzoyl-3-hydroxyphenoxy) ethylacrylate], [2,2,6,6-tetramethyl-4-piperidinyl/β,β,β',β'-tetramethyl-3,9-(2,4,8,10-tetraoxospiro(5,5)undecane) diethyl]-1,2,3,4-butane tetracarboxylate, [1,2,2,6,6-pentamethyl-4-piperidinyl/β,β,β',β'-tetramethyl-3,9-(2,4,8,10-tetraoxospiro(5,5)undecane) diethyl]-1,2,3,4-butane tetrecarboxylate, 2-dodecyl-N-(2,2,6,6-tetramethyl-4-piperidinyl) succinimide, 2-dodecyl-N-(1,2,2,6,6-pentamethyl-4-piperidinyl) succinimide, N-(1-acetyl-2,2,6,6-tetramethyl-4-piperidinyl)-2-dodecyl succinimide, tetrasodium N-(1,2-dicarboxyethyl)-N-octadecyl sulfosuccinamate, poly[N,N-bis(2,2,6,6-tetramethyl-4-piperidinyl)-1,6-hexanediamine-co-2,4-dichloro-6-morpholino-1,3,5-triazine], didodecyl 3,3'-thiodipropionate, dioctadecyl 3,3'-thiodipropionate, 1,6-hexamethylene bis(3,5-di-tert-butyl-4-hydroxy hydrocinnamate), tetrakis [methylene(3,5-di-tert-butyl-4-hydroxy hydrocinnamate)], 2,2'-ethylidene bis(4,6-di-tert-butylphenyl) fluorophosphonite, 2,2,4-trimethyl-1,2-hydroquinoline, N,N'-bis(1,4-dimethyl pentyl)-ρ-phenylene diamine, 2,4,6-tris-(N-104-dimethyl pentyl-ρ-phenylene diamino)-1,3,5-triazine, and mixtures thereof.

16. A transparency in accordance with claim 6 wherein the filler is selected from the group consisting of sodium borosilicate glass hollow microspheres, hollow microspheres of phenolic polymers, vinylidene chloride-acrylonitrile, hollow microspheres, sodium metasilicate pentahydrate, magnesium oxide, zirconium oxide, colloidal silica, titanium dioxide, calcium carbonate, zinc oxide, barium titanate, and antimony oxide.

17. A transparency in accordance with claim 6 wherein the thickness of the second ink receiving coating layer in contact with the first heat and fire resistant layer is from about 0.1 to about 25 microns.

18. A transparency in accordance with claim 6 wherein the haze value of said transparency is from about 0.5 to about 5.

19. A transparency in accordance with claim 6 wherein the substrate is selected from the group consisting of (1) polyethylene terephthalate, (2) polyethylene naphthalates, (3) polycarbonates, (4) polysulfones, (5) polyether sulfones, (6) poly(arylene sulfones), (7) cellulose triacetate, (8) polyvinyl chloride, (9) cellophane, (10) polyvinyl fluoride, (11 ) polypropylene, and (12) polyimides.

20. A transparency in accordance with claim 6 wherein said melting point is from about 150° C. to about 260° C. and said fire retardant component is a halogenated phosphate; said second coating layer being comprised of a blend of a hydrophilic polysaccharide, or a polyvinyl based polymer, an the ink spreading hyroxy acid; the lightfastness component is benzoate, benzophenone, or a hindered amine; the filler is colloidal silica, and which transparency possesses a haze value of from about 0.5 to about 10 and a lightfastness value of from about 95 to about 98.

21. A transparency comprised of a supporting substrate, and thereover and thereunder coatings, a first heat dissipating and fire resistant coating layer in contact with the substrate, and wherein said first coating is comprised of a binder with a melting point in the range of from about 100° C. to about 275° C. and a heat dissipating fire retardant component, and a second ink receiving coating layer thereover and thereunder comprising a blend of a binder polymer, a monomeric, or polymeric cationic component capable of complexing with an ink composition dye, a lightfastness component mixture, an acid ink spreading component, a filler, and a biocide.

* * * * *